US008602613B2

(12) United States Patent
Pike et al.

(10) Patent No.: US 8,602,613 B2
(45) Date of Patent: Dec. 10, 2013

(54) ADJUSTABLE HEIGHT LANDSCAPE LIGHT FIXTURE

(75) Inventors: Arne G. Pike, San Diego, CA (US); Darrin I. Schmuckle, Vista, CA (US); Richard E. Hunter, San Diego, CA (US)

(73) Assignee: Hunter Industries, Inc., San Marcos, CA (US)

( * ) Notice: Subject to any disclaimer, the term of this patent is extended or adjusted under 35 U.S.C. 154(b) by 331 days.

(21) Appl. No.: 13/073,856

(22) Filed: Mar. 28, 2011

(65) Prior Publication Data

US 2012/0250337 A1 Oct. 4, 2012

(51) Int. Cl.
*F21S 8/08* (2006.01)

(52) U.S. Cl.
USPC ..... 362/418; 362/153; 362/431

(58) Field of Classification Search
USPC ..... 362/153, 267, 285, 386, 403, 413, 418, 362/431
See application file for complete search history.

(56) References Cited

U.S. PATENT DOCUMENTS

| | | | | | |
|---|---|---|---|---|---|
| 4,874,991 | A * | 10/1989 | Ruskin | 362/413 |
| 5,704,704 | A * | 1/1998 | Reichard et al. | 362/267 |
| 5,800,053 | A * | 9/1998 | Shen | 362/285 |
| 6,299,075 | B1 | 10/2001 | Koller | 239/106 |
| 6,357,892 | B1 | 3/2002 | Beadle | 362/267 |
| 6,422,717 | B1 | 7/2002 | Beadle | 362/285 |
| 6,874,905 | B1 | 4/2005 | Beadle | 362/153.1 |
| 6,957,782 | B2 | 10/2005 | Clark et al. | 239/200 |
| 7,387,409 | B1 | 6/2008 | Beadle | 362/308 |
| 2010/0084985 | A1 | 4/2010 | Woytowitz | 315/210 |

* cited by examiner

*Primary Examiner* — Y My Quach Lee
(74) *Attorney, Agent, or Firm* — Knobbe, Martens, Olson & Bear LLP

(57) ABSTRACT

An adjustable height landscape light fixture includes an outer cylindrical body portion having a upper threaded segment and an inner riser portion telescopically mounted in the outer cylindrical body portion. A collet surrounds the inner riser portion. A threaded cap is screwed over the upper threaded segment of the cylindrical body portion. The threaded cap is configured to squeeze the collet against the inner riser portion to fix and un-fix a predetermined longitudinal position of the inner riser portion relative to the outer cylindrical body portion and provide a substantially water impervious seal between the threaded cap and the inner riser portion. An incandescent or LED upper light portion is mounted to an upper end of the inner riser portion.

23 Claims, 24 Drawing Sheets

ADJUSTABLE HEIGHT LANDSCAPE LIGHT FIXTURE

FIELD OF THE INVENTION

The present invention relates to light fixtures, and more particularly, incandescent and LED light fixtures installed around lawns and gardens of residential and commercial properties.

BACKGROUND

Outdoor landscape lighting is popular for security, aesthetic, safety, and other reasons. It is known in the outdoor lighting industry to mount a landscape light fixture on the top of a telescoping riser whose lower end is planted in the ground. This allows the height of the light fixture above an adjacent pathway or nearby vegetation to be adjusted. This is often done semi-annually to adjust the height of the landscape light fixture relative to accumulated snow.

In a first type of commercially available telescoping landscape light fixture the height of an inner metallic tubular member relative to a concentric outer tubular metallic member is fixed using a set screw threaded through the side of the outer tubular member near its upper end. A metal collar is attached to the upper end of the inner tubular member with another set screw that extends through the side of the metal collar. The metal collar has a threaded vertical bore for mounting a landscape light fixture. The lower end of the outer tubular member is cut at an angle to facilitate insertion into the ground. In a second type of commercially available telescoping landscape light support the inner and outer tubular members are made of PVC plastic.

Recent advances in LED technology have led to an increased demand for improved landscape light fixtures and their means of mounting. The commercially available telescoping landscape light fixture supports have many drawbacks.

SUMMARY OF THE INVENTION

In accordance with one aspect of the present invention an adjustable height landscape light fixture includes an outer cylindrical body portion having an upper threaded segment and an inner riser portion telescopically mounted in the outer cylindrical body portion. A collet surrounds the inner riser. A threaded cap is screwed over the upper threaded segment of the cylindrical body portion. The threaded cap is configured to squeeze the collet against the inner riser portion to fix and un-fix a predetermined longitudinal position of the inner riser portion relative to the outer cylindrical body portion. An upper light portion is mounted to an upper end of the inner riser portion.

BRIEF DESCRIPTION OF THE DRAWINGS

FIG. 1 illustrates the riser of the light fixture in a retracted position and a path light of the light fixture in phantom lines at the upper end of the riser.

Throughout the figures like reference numerals refer to like parts.

DETAILED DESCRIPTION

The prior art telescoping landscape light fixture supports previously described herein suffer from a number of drawbacks. The first type of prior art telescoping landscape light fixture support often results in visible marring of the inner tubular member because the set screw digs into the same. Damage to the inner tubular member is undesirable, particularly in installations where there is snow in winter and the light fixture is raised above snow lever during winter, and then lowered when spring arrives. It is therefore important not to damage the decorative surface the inner tubular member. The metallic tubular members, especially those made of Copper or Aluminum, are subject to severe corrosion, particularly where the telescoping landscape light fixture support is planted in soils with high organic and moisture content. Both the first and second types of telescoping landscape light fixture support have inadequate room for storing extra cable, and therefore the cable can become crimped when the upper light portion is screwed on to the light fixture support. This also makes it difficult to raise and lower the upper light portion since there is no place to store extra cable. Moreover both prior art types of telescoping landscape light fixture support can twist in the ground during this process, resulting in a loose planting. In addition, water can leak down between the two tubular members of both prior art types of telescoping landscape light fixture supports.

Figure 1:
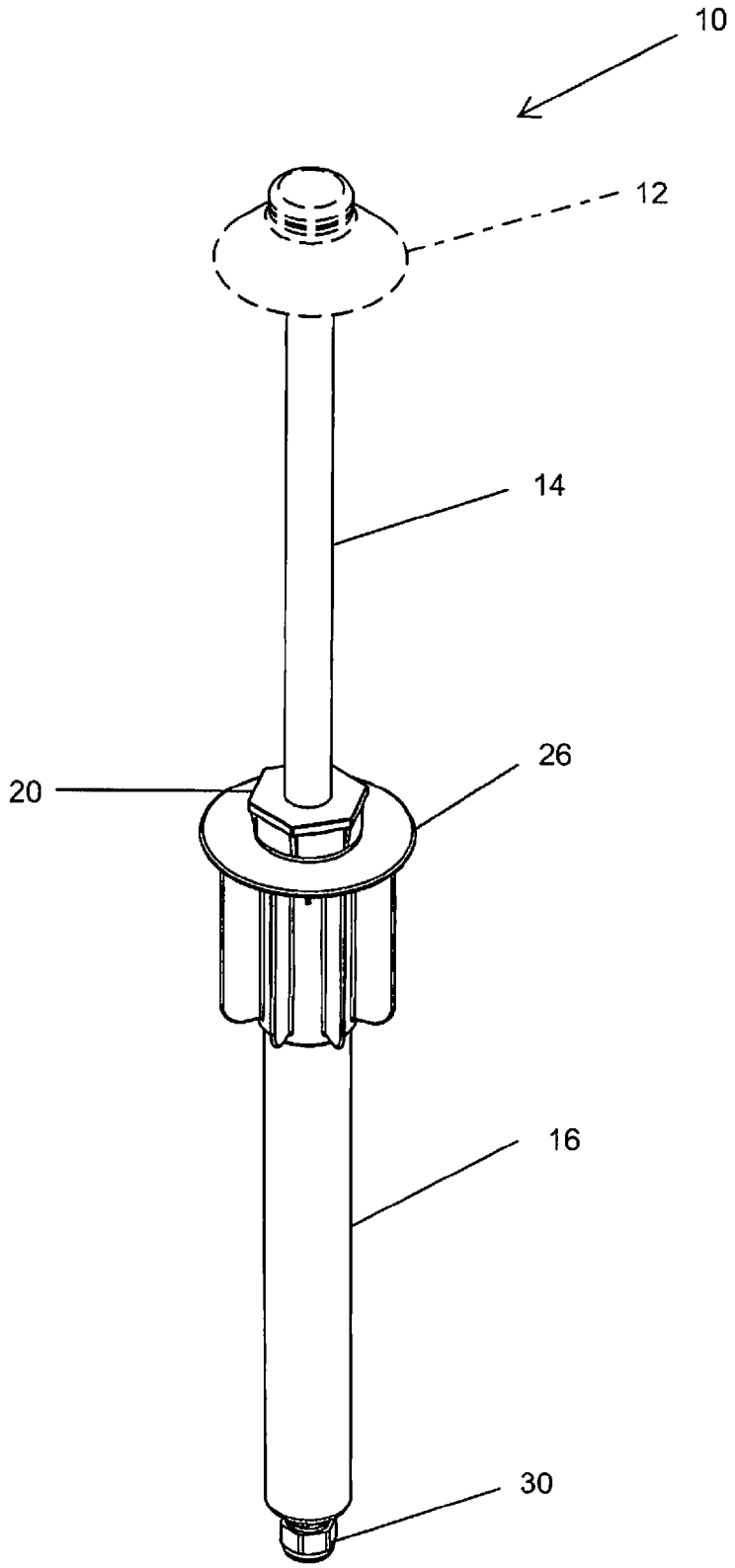
FIG. 1 is an isometric view of a landscape light fixture in accordance with a first embodiment of the present invention.
Figure 2:
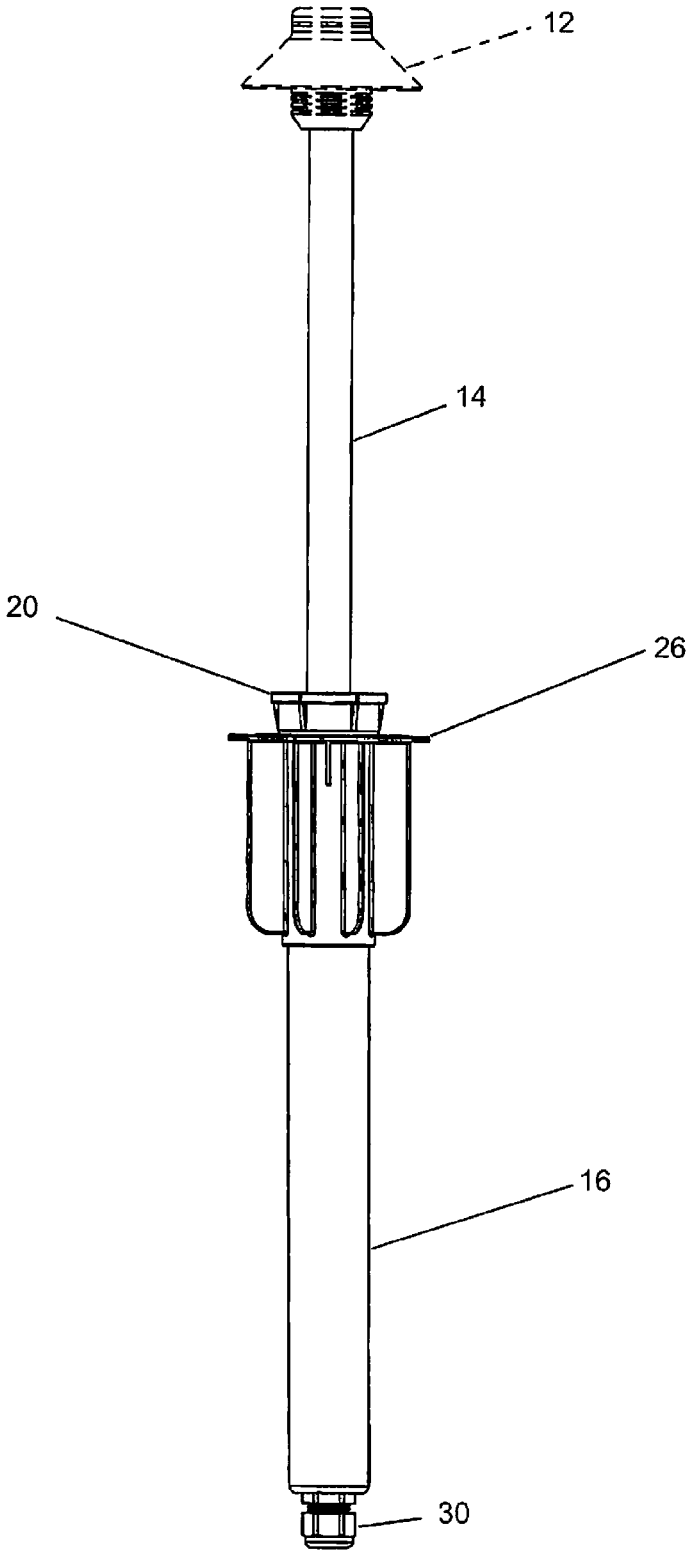
FIG. 2 is a side elevation view of the light fixture of FIG. 1.

Referring to FIG. 1, a landscape light fixture 10 in accordance with a first embodiment of the present invention includes an upper light portion 12 mounted to the upper end of a tubular metallic inner riser portion 14. The inner riser portion 14 is concentrically mounted within, and telescopes from, a generally cylindrical plastic outer body portion 16. The light fixture 10 has a symmetrical configuration and therefore all side elevation views from different angles are essentially identical. The lower end of the outer body portion 16 is normally planted in the ground adjacent a pathway in a landscaped area. The amount of extension of the inner riser portion 14 relative to the outer body portion is initially selected by the installer so that the upper light portion 12 is above the height of the adjacent shrubs or walkway. In winter, the height of the upper light portion 12 can be raised as necessary to place it above the tops of adjacent snow drifts. In spring the upper light portion 12 can be lowered back to its original height.

By way of example, and not by way of limitation, the upper light portion 12 of the light fixture 10 may take the form of a path light as illustrated in FIG. 1. Alternatively, again by way of example, the upper light portion 12 may be of the incandescent types disclosed in U.S. Pat. No. 6,784,905 granted Apr. 5, 2005 to Joshua Z. Beadle or U.S. Pat. No. 7,387,409 granted Jun. 17, 2008 to Joshua Z. Beadle, the entire disclosures of which are hereby incorporated by reference. Alternatively, again by way of example, and not by way of limitation, the upper light portion 12 may be of the intelligent LED type disclosed in U.S. patent application Ser. No. 12/564,840 filed Sep. 22, 2009 by Peter J. Woytowitz entitled "Low Voltage Outdoor Lighting Power Source and Control System" and published Apr. 8, 2010 under Publication No. US-2010-0084985-A1, the entire disclosure of which is hereby incorporated by reference.

The light fixture 10 incorporates a novel ornamental design as illustrated in FIGS. 1, 2 5B and 5C. The light fixture 10 is symmetrical in configuration and appearance, i.e. the front, back, left and right side elevation views of its design are all essentially the same.

The cylindrical outer body portion 16 may be injection molded out of suitable plastic such as black ABS that is corrosion resistant when buried in the soil, with or without UV resistant additives. Again, by way of example, the cylindrical outer body portion 16 may be an outer sprinkler case normally used for a pop-up spray type sprinkler such as a Pro-Spray® pop-up spray type sprinkler. See U.S. Pat. No. 6,299,075 granted Oct. 9, 2001 to Izaak M. Koller and U.S. Pat. No. 6,957,782 granted Oct. 25, 2005 to Michael L. Clark et al., the entire disclosures of which are hereby incorporated by reference. The outer body portion 16 will not corrode in soils with high organic and moisture content. Highly organic soils and high moisture content are common in planter areas where this kind of outdoor light fixture is typically installed.

Figure 6:
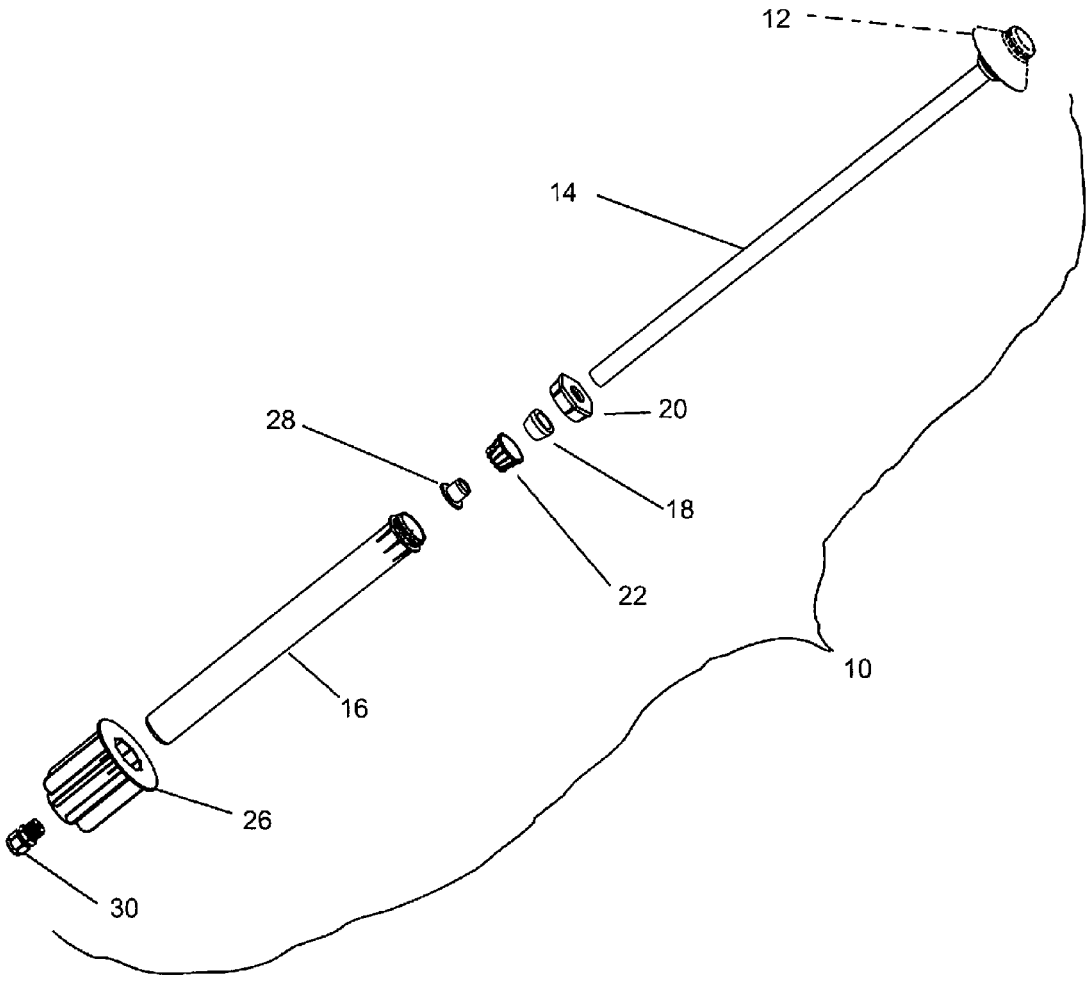
FIG. 6 is a slightly reduced exploded isometric view of the light fixture of FIG. 1.
Figure 7:
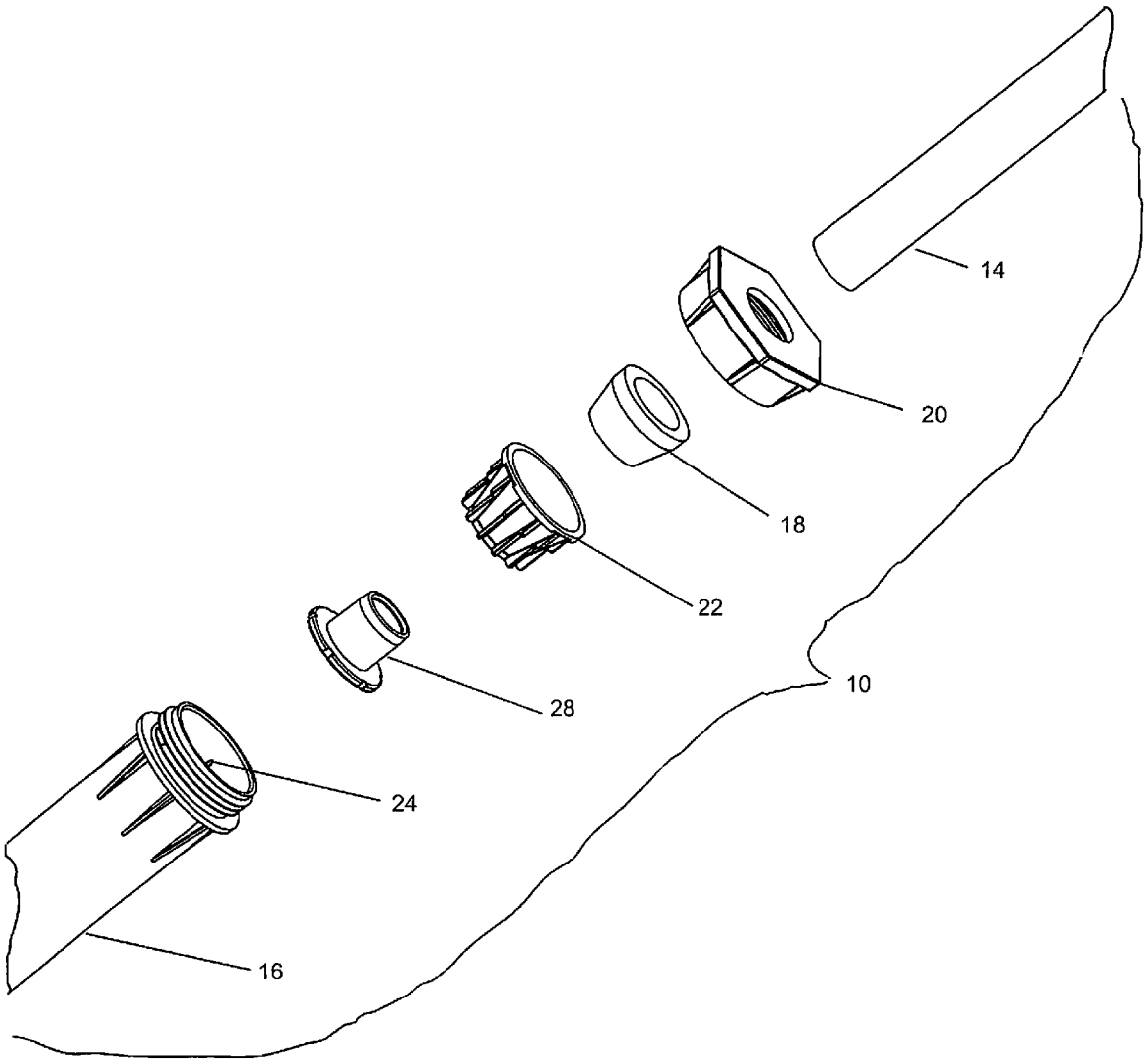
FIG. 7 is an enlarged fragmentary sectional view illustrating details of the collet assembly of the light fixture of FIG. 1.
Figure 8:
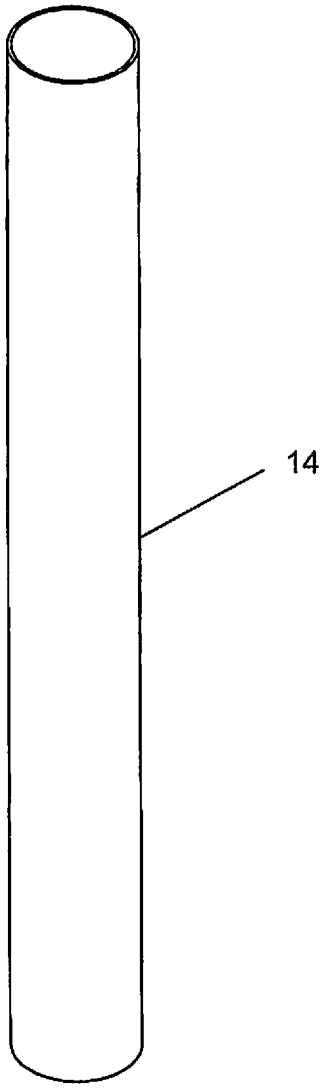
FIG. 8 is an elevation view of a segment of the riser of the light fixture of FIG. 1.
Figure 9A:
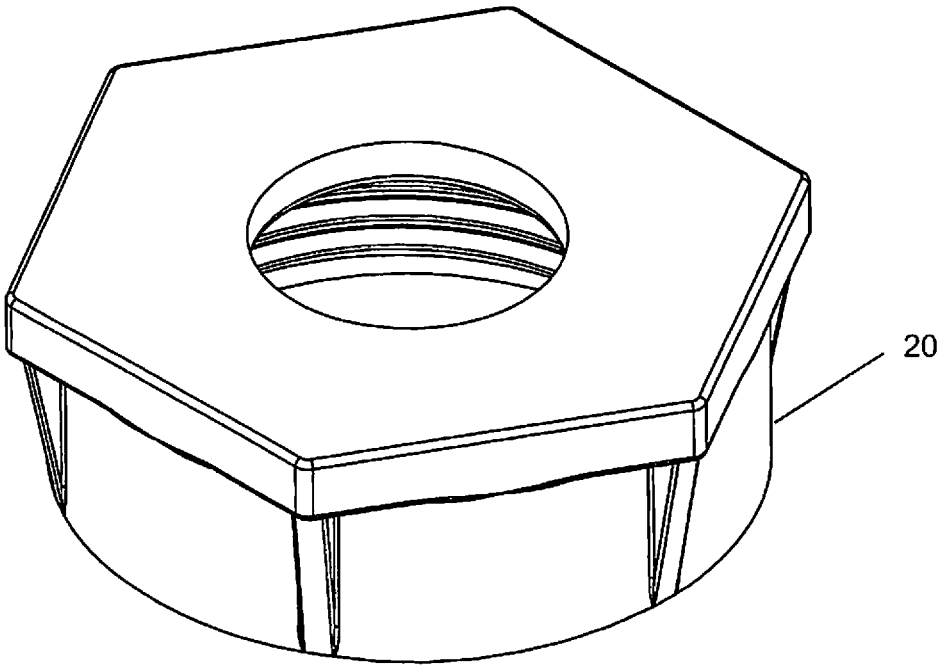
FIG. 9A is an enlarged isometric view of the cap of the light fixture of FIG. 1.
Figure 9B:
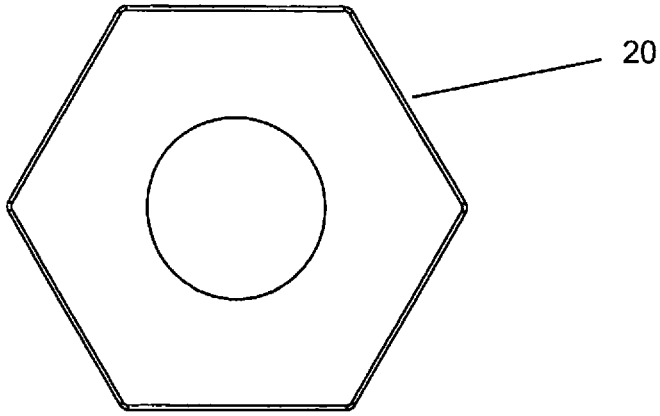
FIG. 9B is an enlarged top plan view of the cap of the light fixture of FIG. 1.
Figure 9C:
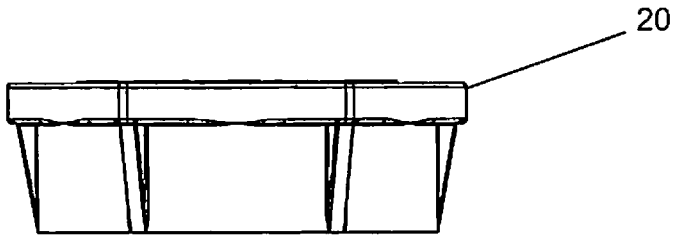
FIG. 9C is an enlarged side elevation view of the cap of the light fixture of FIG. 1.
Figure 9D:
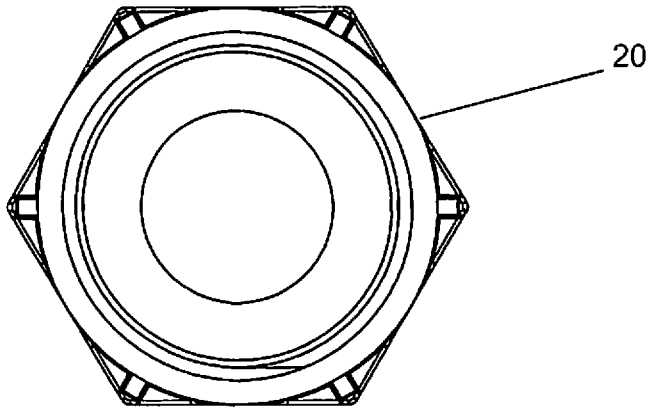
FIG. 9D is a bottom plan view of the cap of the light fixture of FIG. 1.
Figure 10:
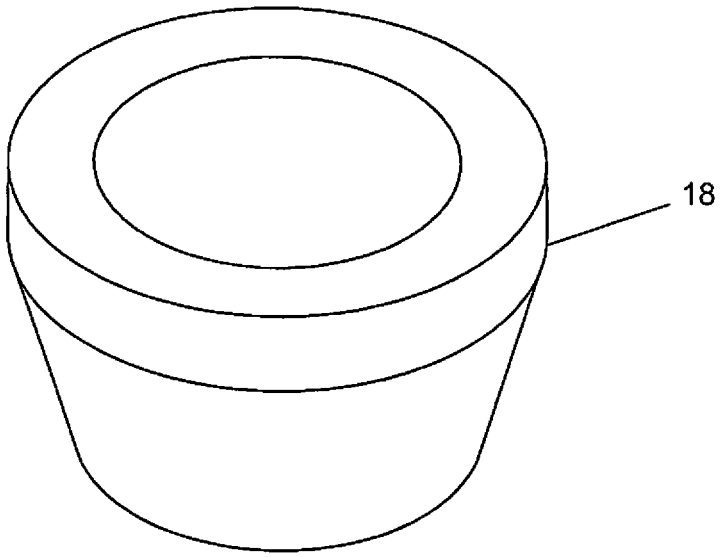
FIG. 10 is an enlarged isometric view of the collet of the light fixture of FIG. 1.

A tapered cylindrical collet 18 (FIGS. 6, 7 and 10) surrounds the inner riser portion 14 and is positioned to provide a substantially water impervious seal between the outer cylindrical body portion 16 and the inner riser portion 14. The seal provided by the collet 18 also prevents contaminants like fine sand from entering the outer cylindrical body portion 16 which could scratch the inner riser portion 14 or make it difficult to raise and lower the upper light portion 12. A hexagonal shaped female threaded plastic cap 20 (FIGS. 6, 7, 9A, 9B, 9C and 9D) is screwed over an upper threaded segment 16*a* of the cylindrical body portion 16. The threaded cap 20 is preferably injection molded out of UV resistant plastic since it will be exposed to ambient sun light. The threaded cap 20 receives the upper end of the collet 18 and is configured to retain the collet 18 against the inner riser portion 14 to fix and un-fix a predetermined longitudinal position of the inner riser portion relative to the outer cylindrical body portion 16. The collet 18 is preferably made of a soft elastomeric material such as Infuse with 25% HDPE with a durometer between 85 Shore A hardness and about 90 Shore A hardness.

Figure 11A:
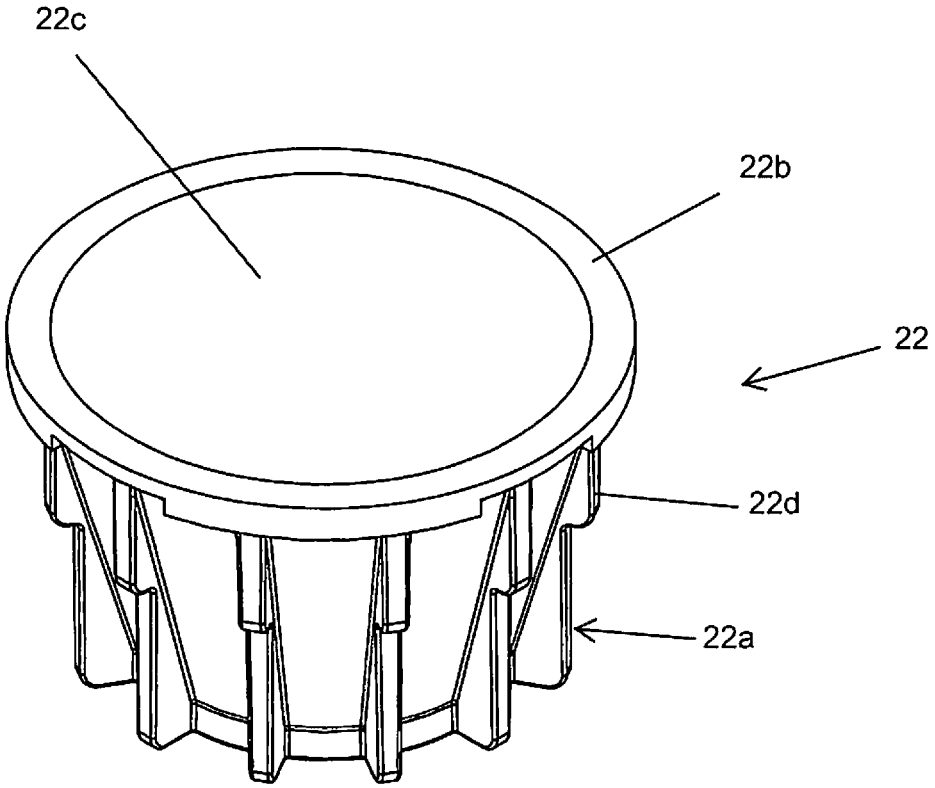
FIG. 11A is an enlarged isometric view of the insert of the light fixture of FIG. 1 that cooperates with the collet.
Figure 11B:
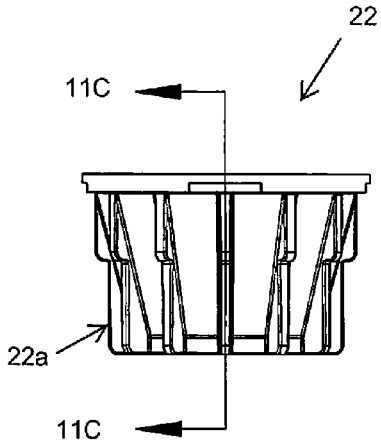
FIG. 11B is a side elevation view of the insert of FIG. 11A
Figure 11C:
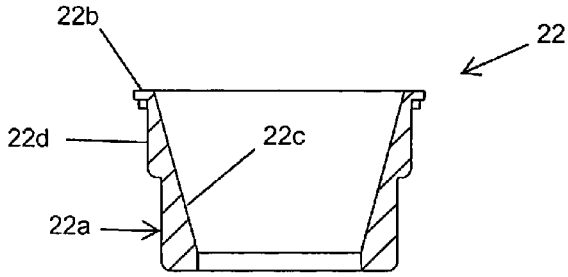
FIG. 11C is a vertical cross sectional view of the insert of FIG. 11B taken along line 11C-11C of FIG. 11B.
Figure 12:
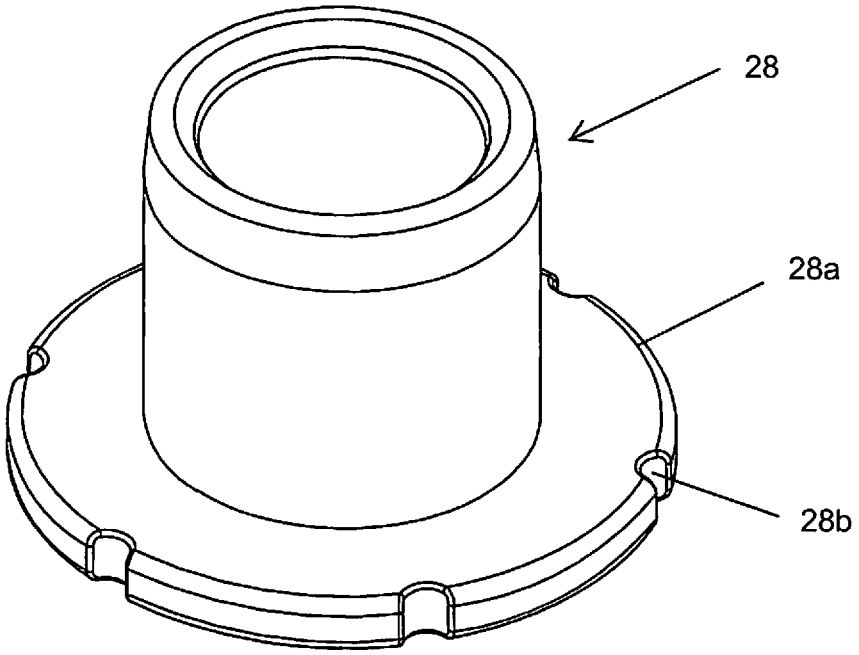
FIG. 12 is an enlarged isometric view of the plug that is press fit into the lower end of the inner riser portion of the light fixture of FIG. 1.

In order to facilitate the ability of the threaded cap 20 to deform the collet 18 and squeeze the same against the inner riser portion 14 a rigid tapered cylindrical insert 22 (FIGS. 6, 7 and 11A-11C) preferably made of a suitable hard plastic is used. The insert 22 has a generally frusto-conical shape with a plurality of circumferentially spaced radially extending stepped ribs 22*a* (FIG. 11A). The inside tapered surface 22*c* fits snugly with and surrounds the outer tapered surface of the collet 18. The upper end of the insert 22 is formed with a circular rim 22*b* having an underside that rests against the upper end of the outer cylindrical body portion 16. The outer cylindrical body portion 16 has a plurality of ribs 24 (FIGS. 7 and 13) that extend radially inwardly from the inner cylindrical surface of the outer cylindrical body portion 16 and are integrally molded therewith. The ribs 24 start approximately *Λ*1;2 of an inch below the upper surface and extend substantially the entire remaining length of the interior surface of the outer cylindrical body portion 16. The upper segment 22*d* of the ribs 22*a* on the cylindrical insert 22 fit snugly to the interior cylindrical surface 16*c* of the outer cylindrical body portion 16.

The insert 22 surrounds the collet 18 and the taper of the insert 22 and the collet 18 are oppositely oriented. Due to this mating relationship when the cap 20 is screwed down clockwise from above, the cap 20 engages the upper end of the collet 18 and deforms the collet radially inwardly against the outer surface of the inner riser portion 14 to securely lock the inner riser portion 14 in position relative to the outer cylindrical body portion 16. Unlike the sets screws used in the prior art telescoping landscape light fixture supports, the soft collet 18 provides an easy to use, reliable locking means that does not scratch or mar the decorative surface Copper inner riser portion 14. The gripping force provided by the collet 18 when squeezed against the inner riser portion 14 is very substantial. This ensures that the upper light portion 12 does not inadvertently descend.

Figure 13:
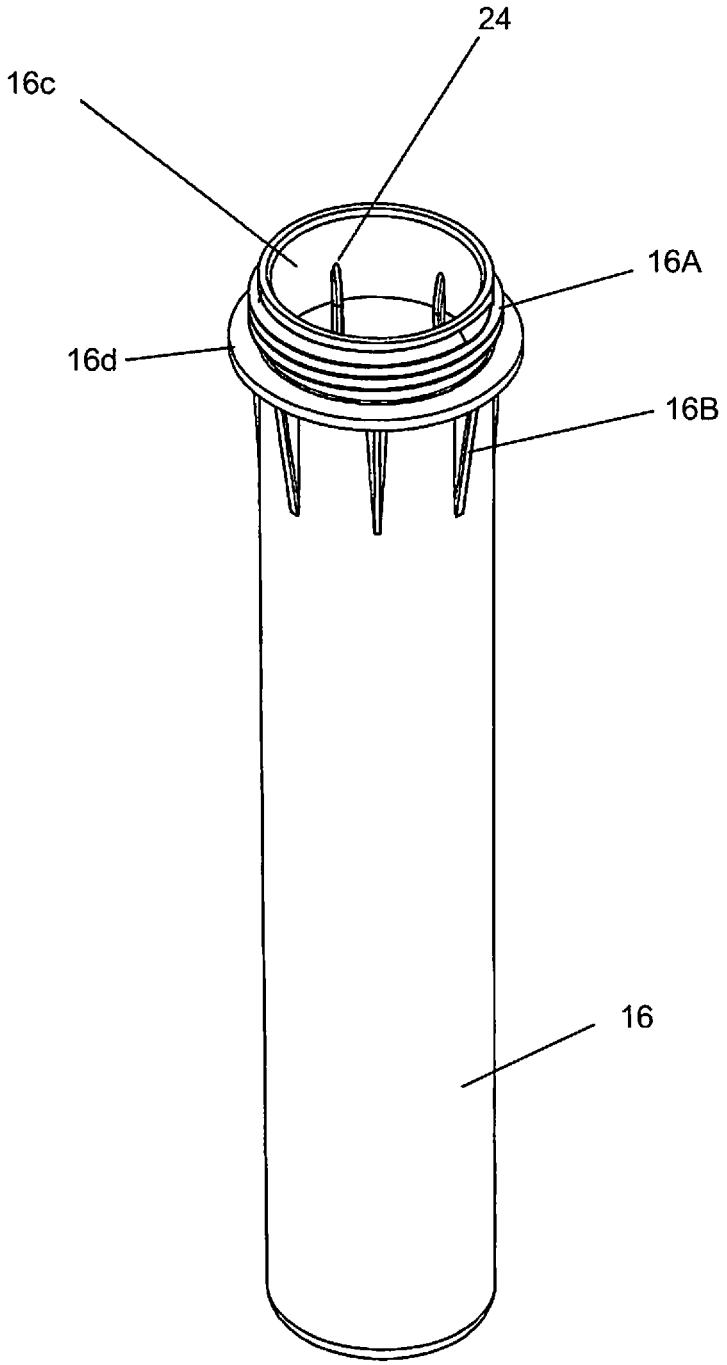
FIG. 13 is an enlarged isometric view of the outer body of the light fixture of FIG. 1.
Figure 14:
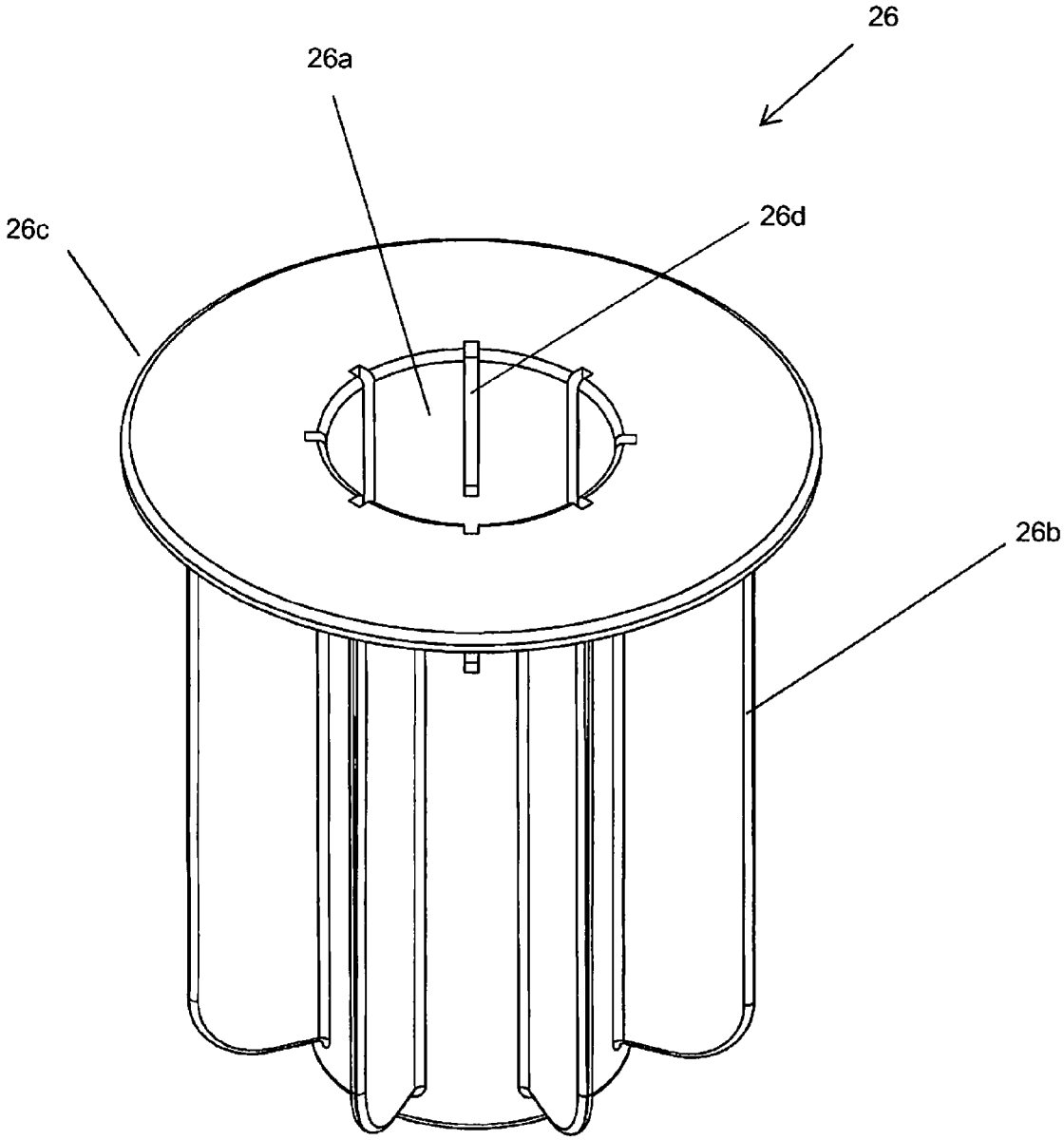
FIG. 14 is an enlarged isometric view of the ground support flange of the light fixture of FIG. 1.
Figure 16:
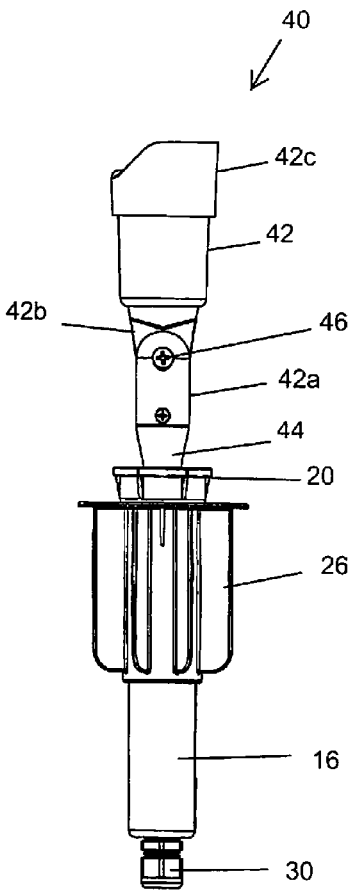
FIG. 16 is a side elevation view of the light fixture of FIG. 15.
Figure 15:
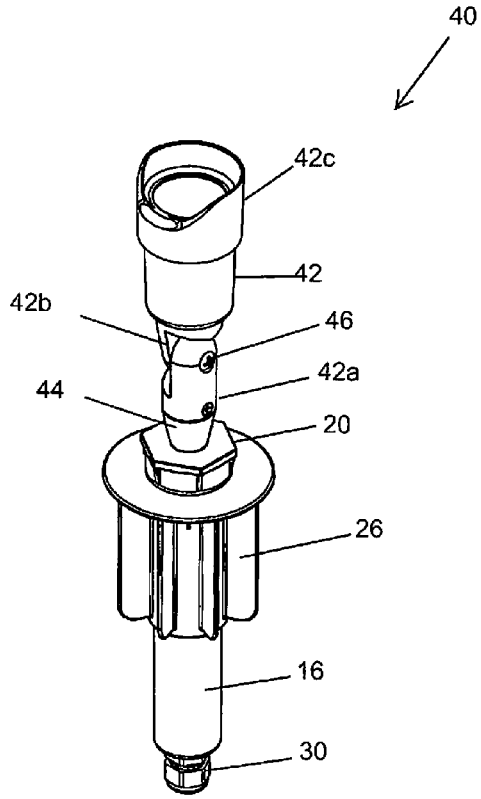
FIG. 15 is an isometric view of a second embodiment of the light fixture of the present invention that includes a removable up-light.
Figure 17:
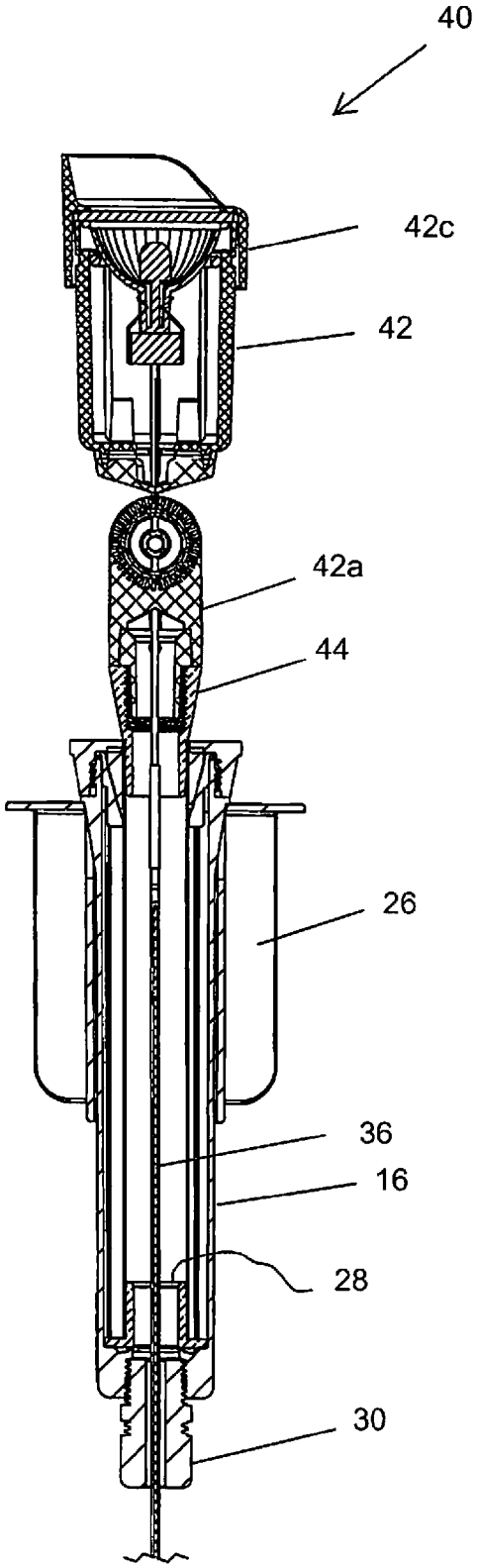
FIG. 17 is an enlarged vertical sectional view through the light fixture of FIG. 15 with its riser in a retracted position and illustrating a cable extending from a lower end of the light fixture.

The light fixture 10 can optionally include a ground support flange 26 (FIGS. 1, 2, 4 and 14) that surrounds the outer cylindrical body portion 16 and is prevented from slipping off the upper end of the outer cylindrical body portion 16 by the upper flange 16*d* (FIG. 13). The ground support flange 26 is preferably injection molded of ABS or other suitable plastic and includes a central cylindrical portion 26*a* (FIG. 14), and a plurality of radially extending fins 26*b* that terminate at their upper ends and join with a circular horizontal flange 26*c*. The circular horizontal flange 26*c* rests on top of the ground after the outer cylindrical body portion 16 has been buried in the ground. The fins 26*b* prevent the ground implanted outer cylindrical body portion 16 from rotating when the cap 20 is tightened or loosened. The cylindrical portion 26*a* is formed with a plurality of grooves 26*d* that are sized and positioned to receive a plurality of radially extending triangular fins 16*b* (FIG. 13) integrally formed on the upper exterior of the outer cylindrical body portion 16. This prevents relative rotation between the ground support flange 26 and the outer cylindrical body portion 16.

Figure 3:
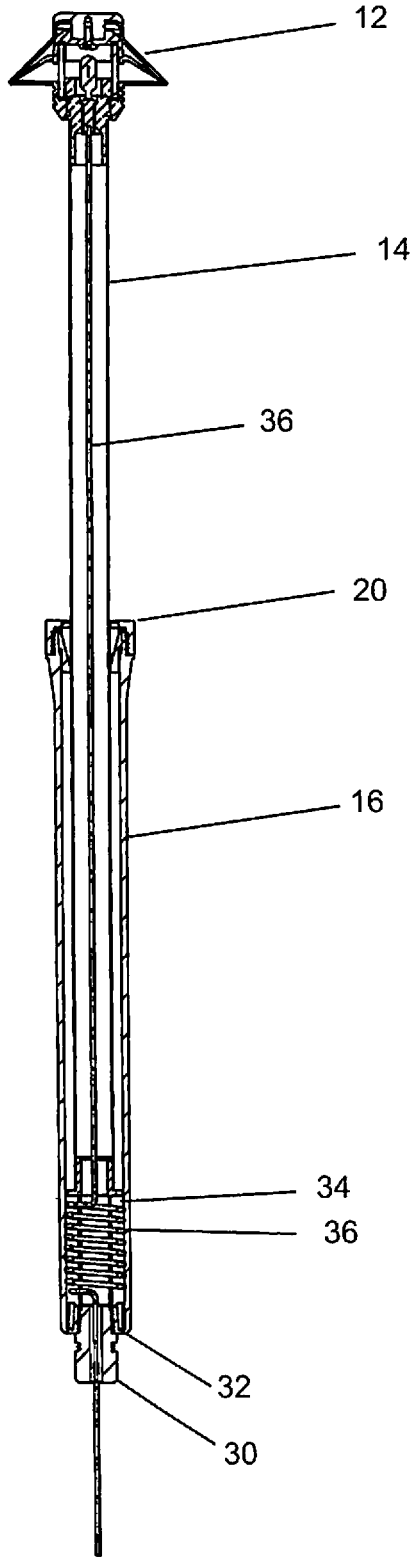
FIG. 3 is a vertical sectional view through the light fixture of FIG. 2. The ground support flange of the light fixture has been removed in this view. A length of cable is illustrated that extends through the lower end of the light fixture and connects with the path light.
Figure 4:
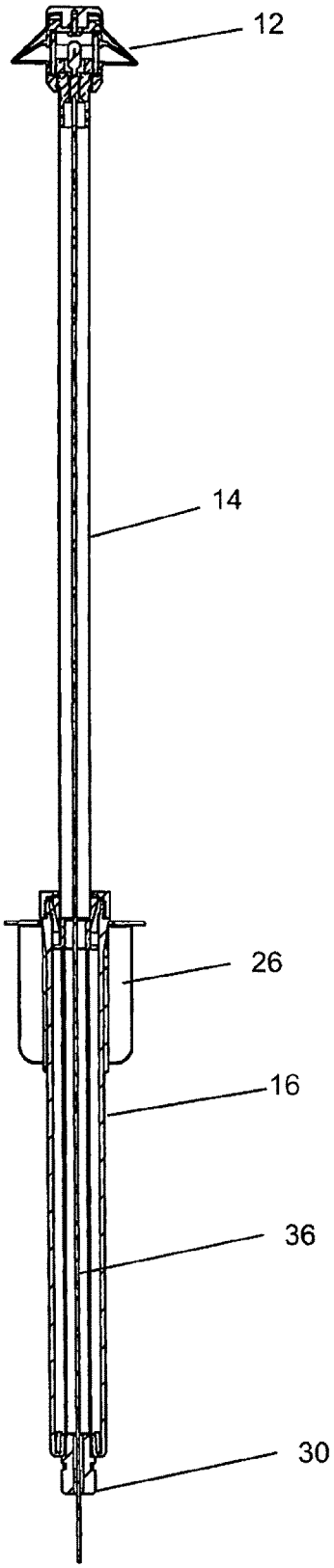
FIG. 4 is a vertical sectional view through the light fixture of FIG. 2 with the riser in an extended position
Figure 5A:
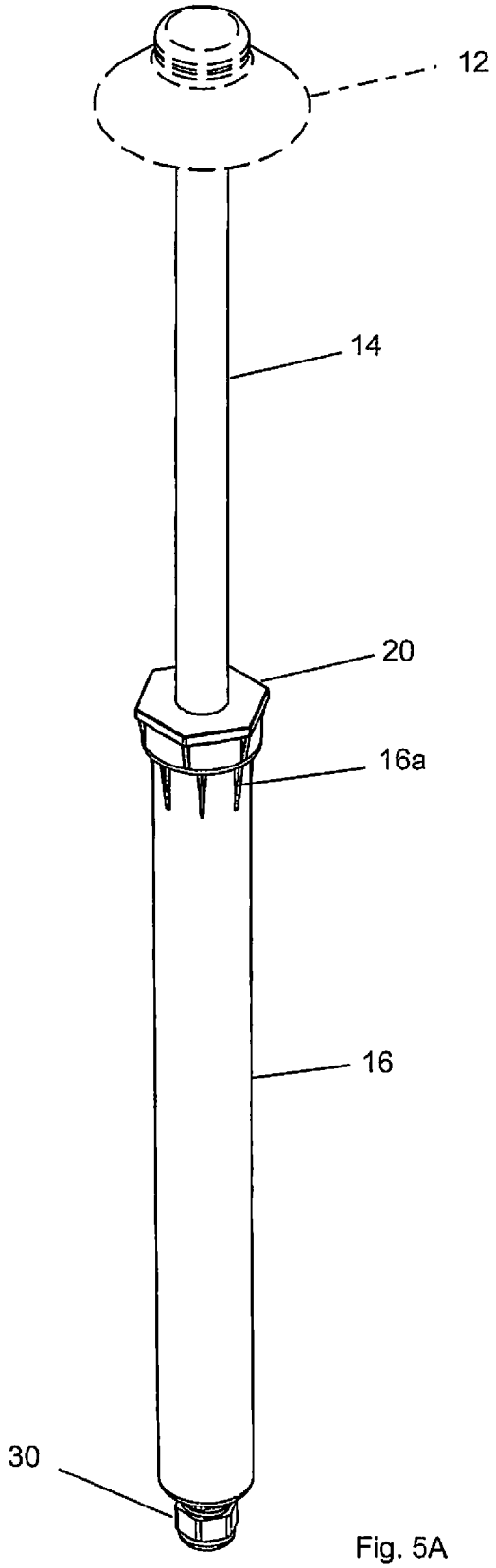
FIG. 5A is a view similar to FIG. 1 with the ground support flange removed.
Figure 5B:
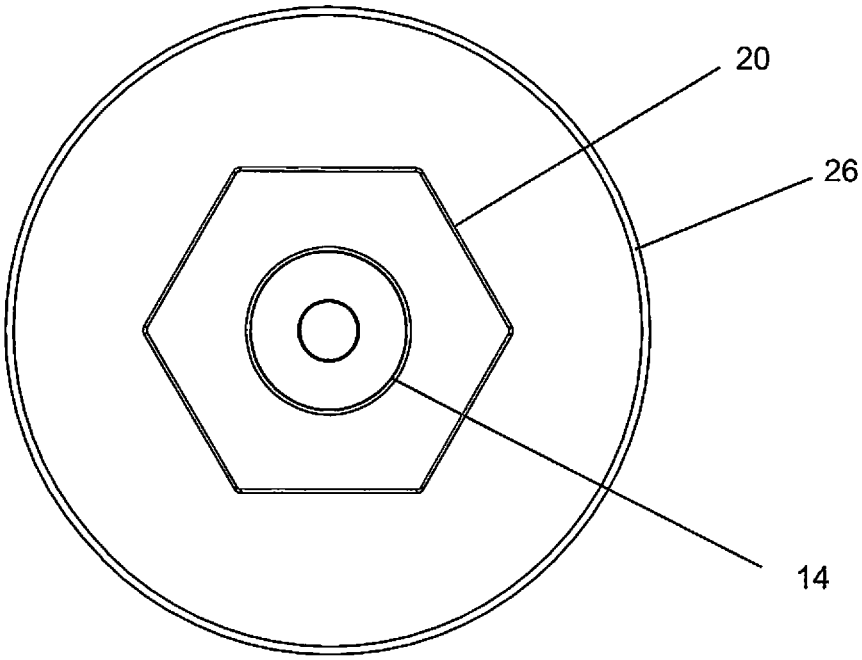
FIG. 5B is a top plan view of the light fixture of FIG. 1 with the path light removed.
Figure 5C:
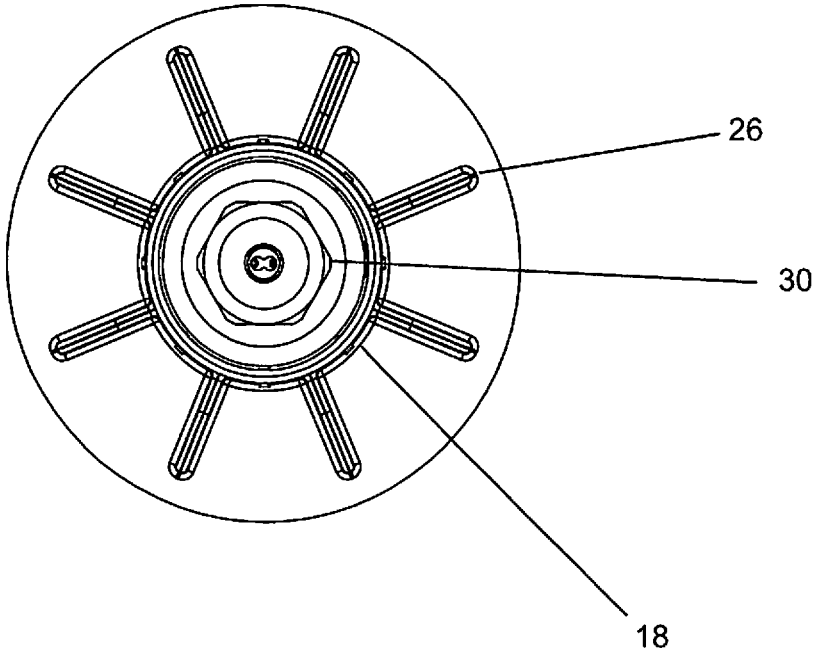
FIG. 5C is a bottom plan view of the light fixture of FIG. 1 with the path light removed.

A cylindrical plastic plug 28 (FIG. 7) is inserted into the lower end of the Copper inner riser portion 14. The cylindrical plug 28 has a circular flange 28*a* with a plurality of arcuate recesses 28*b* formed therein at spaced intervals dimensioned so that each receives and engages the ribs 24 of the outer cylindrical body portion 16 to keep the lower end of the inner riser portion concentrically centered. The engagement of the ribs 24 and the arcuate recesses 28*b* also prevents the inner riser portion 14 from rotating. Thus, the proper rotational orientation of the upper light portion 12 is maintained, which is particularly important where the upper light portion 12 is configured as a spot light that points toward a wall, tree, etc. A standard ½ inch male threaded NPT plastic water tight strain relief fitting 30 (FIGS. 1, 3 and 6) is screwed into a female threaded bore 32 (FIG. 3) in the lower end of the outer cylindrical body portion 16. There is sufficient space 34 below the inner riser portion 14 and within the outer body portion 16 for excess wire or cable 36 to collect when the upper light portion 12 is lowered, or to store extra length of the cable 36 (FIG. 3), so it is easy to raise the upper light portion 12 at a later time. The fitting 30 clamps around the cable 36 to anchor the cable in position relative to the outer cylindrical body portion 16.

Figure 18:
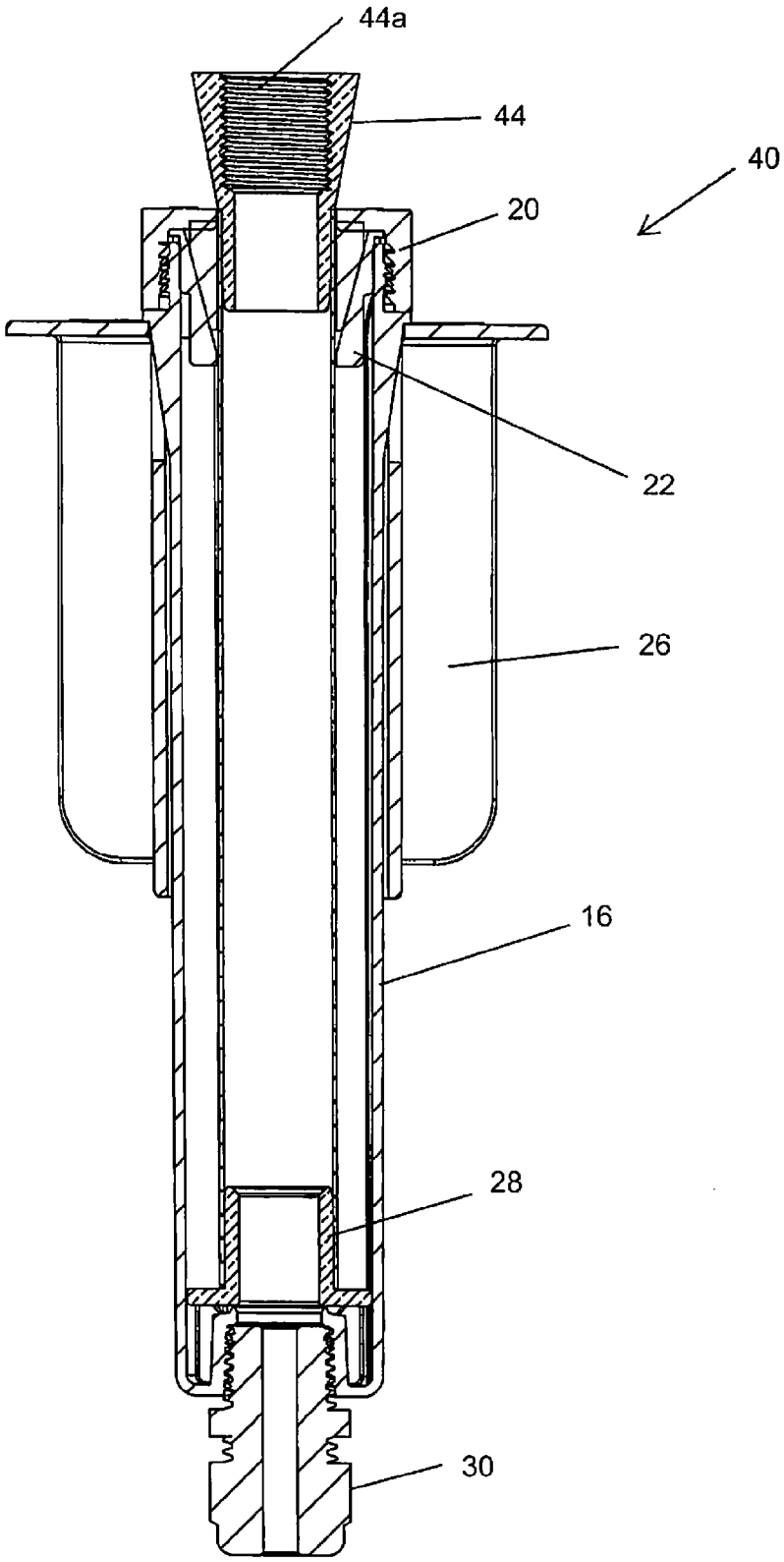
FIG. 18 is an enlarged portion of the light fixture of FIG. 15 illustrating further details of its construction.
Figure 19:
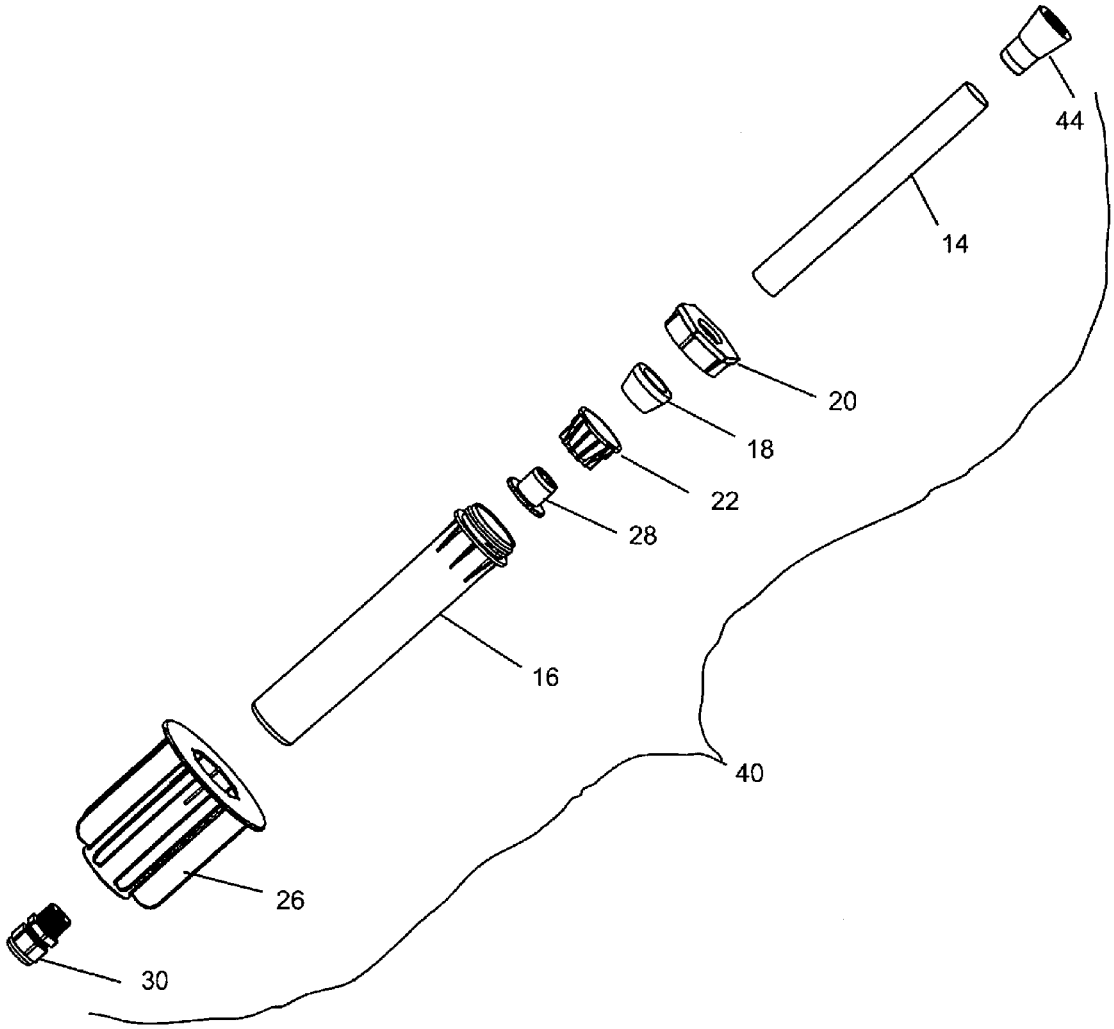
FIG. 19 is slightly reduced exploded isometric view of the components of the second embodiment illustrated in FIG. 18.
Figure 20:
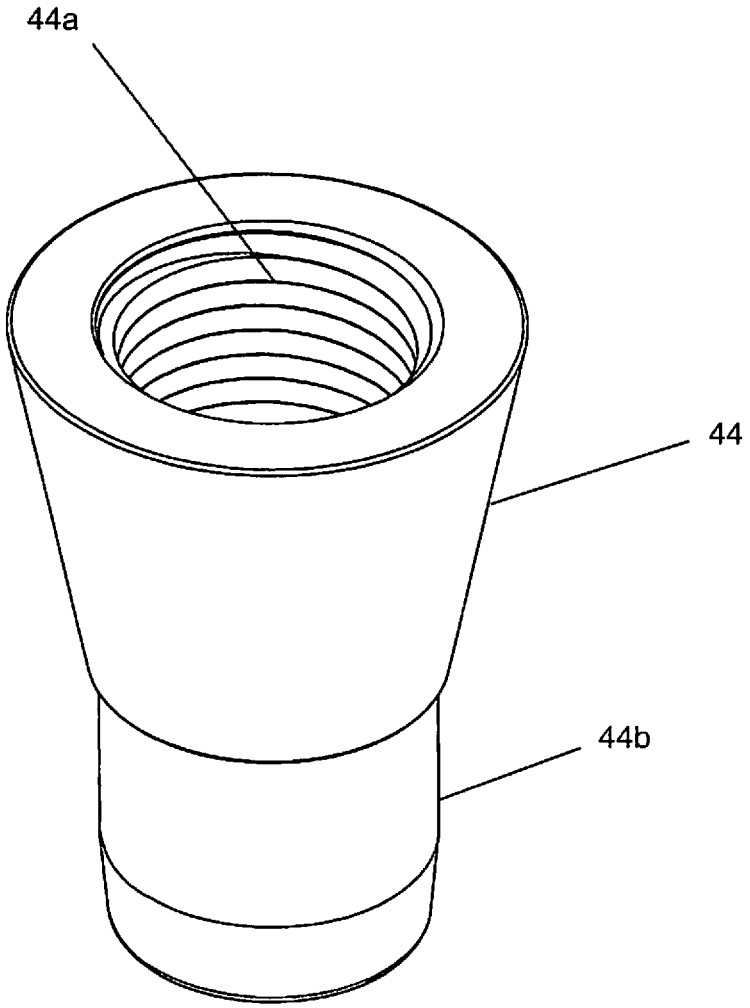
FIG. 20 is an isometric view of the threaded adaptor of the second embodiment.
Figure 21B:
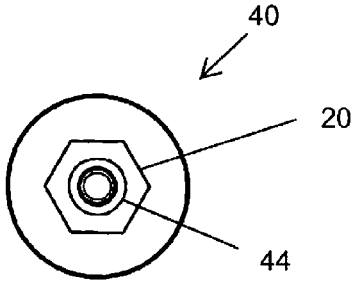
FIG. 21B is a top plan view of the light fixture of FIG. 15 with the up-light removed.
Figure 21C:
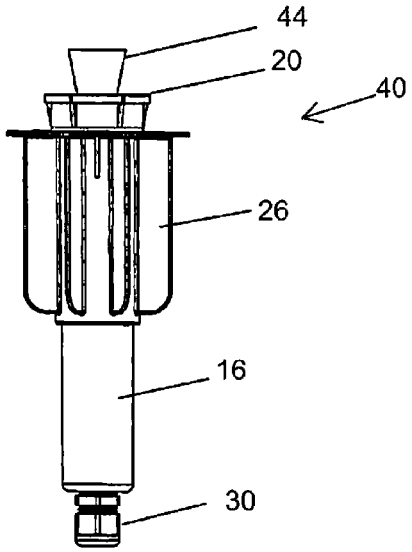
FIG. 21C is a side elevation view of the light fixture of FIG. 15 with the up-light removed.
Figure 21D:
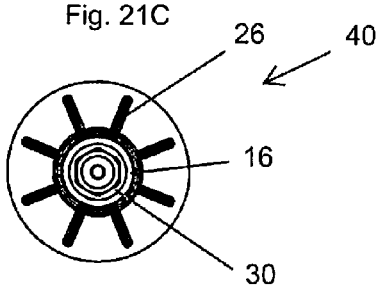
FIG. 21D is a bottom plan view of the light fixture of FIG. 15.
Figure 21A:
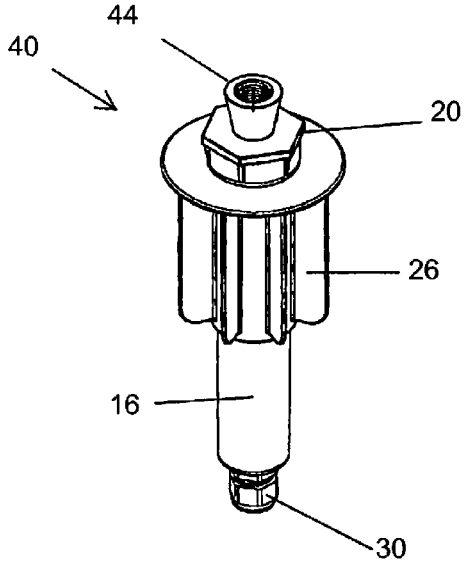
FIG. 21A is an isometric view of the light fixture of FIG. 15 with the up-light removed.

FIGS. 15-21D illustrate a second embodiment a light fixture 40 in accordance with the present invention that includes a removable up-light 42. The light fixture 40 includes an upper female threaded adaptor 44 (FIGS. 18 and 20). The adaptor 44 has an inverted frusto-conical configuration that includes a standard ½ inch NPT threaded segment 44*a*. A lower cylindrical segment 44*b* (FIG. 20) of the adaptor 44 is press fit into the upper end of the inner riser portion 14. The adaptor 44 allows various configurations of upper light portions to be quickly mounted on the remainder of the light fixture 40. The up-light 42 includes mating neck portions 42*a* and 42*b* that are pivotally connected by a screw 46 that can be loosened to allow the angle of an upper lamp portion 42*c* to be adjusted. The construction of the light fixture 40 is otherwise similar to the light fixture 10.

Even without the removable up-light 42, the light fixture 40 incorporates a novel ornamental design as illustrated in FIGS. 21A-21D. The light fixture 40 is symmetrical in configuration and appearance, i.e. the front, back, left and right side elevation views of its design are all essentially the same.

While several embodiments of an adjustable height landscape light fixture have been described, along with an optional ground support flange that can be used therewith, variations and modifications thereof will occur to those skilled in the art. Therefore the protection afforded the invention should only be limited in accordance with the scope of the following claims.

What is claimed is:

1. An adjustable height landscape light fixture, comprising:

an outer cylindrical body portion having an upper threaded segment;

a ground support flange surrounding the outer cylindrical body portion;

an inner riser portion telescopically mounted in the outer cylindrical body portion;

a collet surrounding the inner riser portion;

a threaded cap screwed over the upper threaded segment of the cylindrical body portion and configured to squeeze the collet against the inner riser portion to fix and un-fix a predetermined longitudinal position of the inner riser portion relative to the outer cylindrical body portion; and an upper light portion mounted to an upper end of the inner riser portion.

2. The light fixture of claim 1 wherein the collet is positioned to provide a substantially water impervious seal between the threaded cap and the inner riser portion.

3. The light fixture of claim 1 wherein the collet is tapered.

4. The light fixture of claim 3 and further comprising a tapered insert surrounding the collet that cooperates with the threaded cap to squeeze the collet against the inner riser portion.

5. The light fixture of claim 1 wherein the collet is made of a soft elastomeric material.

6. The light fixture of claim 1 and further comprising a plug that is inserted into a lower end of the inner riser portion to center the inner riser portion within the outer cylindrical body.

7. The light fixture of claim 6 wherein the plug that is inserted into a lower end of the inner riser portion is formed with a plurality of recesses that engage ribs inside the outer cylindrical portion to prevent the inner riser from rotating.

8. The light fixture of claim 1 and further comprising a strain relief fitting screwed into a female threaded bore in a lower end of the outer cylindrical body portion.

9. The light fixture of claim 1 wherein the ground support flange has a plurality of radially extending fins.

10. The light fixture of claim 1 wherein the outer cylindrical body portion has a plurality of radially extending ribs formed on an inner cylindrical surface of the outer cylindrical body portion.

11. The light fixture of claim 10 and further comprising a plug that is inserted into a lower end of the inner riser portion and engages the ribs to prevent rotation of the inner riser portion within the outer cylindrical body portion.

12. An adjustable height landscape light fixture, comprising:

an outer cylindrical plastic case having a upper threaded segment and a plurality of radially extending ribs formed on an inner cylindrical surface;

an inner riser portion telescopically mounted in the sprinkler case;

a collet surrounding the inner riser;

a tapered insert surrounding the collet;

a threaded plastic cap screwed over the upper threaded segment of the outer cylindrical case and configured to press down on the tapered insert and squeeze the collet against the inner riser portion to fix and un-fix a predetermined longitudinal position of the inner riser portion relative to the case; and an upper light portion mounted to an upper end of the inner riser portion.

13. The light fixture of claim 12 wherein the collet is positioned to provide a substantially water impervious seal between the threaded plastic cap and the inner riser portion.

14. The light fixture of claim 12 wherein the collet is tapered.

15. The light fixture of claim 14 wherein the tapers of the collet and the insert are oppositely oriented.

16. The light fixture of claim 12 wherein the collet is made of a soft elastomeric material.

17. The light fixture of claim 12 and further comprising a plug that is inserted into a lower end of the inner riser portion to center the inner riser portion within the outer cylindrical case.

18. The light fixture of claim 17 wherein the plug that is inserted into the lower end of the inner riser portion is formed with recesses that engage ribs inside the outer cylindrical portion to prevent the inner riser from rotating.

19. The light fixture of claim 12 and further comprising a strain relief fitting screwed into a female threaded bore in a lower end of the outer cylindrical case.

20. The light fixture of claim 12 and further comprising a ground support flange surrounding the outer cylindrical case, the ground support flange having a plurality of radially extending fins that are joined with a circular horizontal flange.

21. The light fixture of claim 12 and further comprising a plug that is inserted into a lower end of the inner riser portion and engages the ribs to concentrically center the inner riser portion within the outer cylindrical case.

22. An adjustable height landscape light fixture, comprising:

an outer cylindrical plastic body portion having a upper male threaded segment and a female threaded bore in a lower end thereof, the outer cylindrical plastic body portion having a plurality of radially extending ribs formed on an inner cylindrical surface of the outer cylindrical plastic body portion;

an inner tubular riser portion concentrically and telescopically mounted in the outer cylindrical plastic body portion;

a tapered soft collet surrounding the inner tubular riser;

a rigid tapered insert surrounding the tapered soft collet;

a female threaded cap screwed over the upper male threaded segment of the outer cylindrical plastic body portion and configured to press down on the rigid tapered insert and squeeze the tapered soft collet against the inner tubular riser portion to fix and un-fix a predetermined longitudinal position of the inner tubular riser portion relative to the outer cylindrical plastic body portion;

the collet being positioned to provide a substantially water impervious seal between the threaded cap and the inner tubular riser portion;

a ground support flange surrounding the outer cylindrical plastic body portion, the ground support flange having a plurality of radially extending fins that are joined with a circular horizontal flange;

a plug that is inserted into a lower end of the inner tubular riser portion that engages the ribs to prevent the riser from rotating and to concentrically center the inner tubular riser portion within the outer cylindrical plastic body portion;

a strain relief fitting screwed into the female threaded bore in the lower end of the outer cylindrical plastic body portion; and an upper light portion mounted to an upper end of the inner tubular riser portion.

23. An adjustable height landscape light fixture, comprising:

an outer cylindrical body portion having an upper threaded segment;

an inner riser portion telescopically mounted in the outer cylindrical body portion;

a collet surrounding the inner riser portion;

a threaded cap screwed over the upper threaded segment of the cylindrical body portion and configured to squeeze the collet against the inner riser portion to fix and un-fix a predetermined longitudinal position of the inner riser portion relative to the outer cylindrical body portion;

an upper light portion mounted to an upper end of the inner riser portion; and a strain relief fitting screwed into a female threaded bore in a lower end of the outer cylindrical body portion.

* * * * *

UNITED STATES PATENT AND TRADEMARK OFFICE

CERTIFICATE OF CORRECTION

PATENT NO. : 8,602,613 B2
APPLICATION NO. : 13/073856
DATED : December 10, 2013
INVENTOR(S) : Pike et al.

It is certified that error appears in the above-identified patent and that said Letters Patent is hereby corrected as shown below:

In the Specification

Column 2 line 2, Change “position” to --position.--.

Column 4 line 27, Change “85” to --about 85--.

Signed and Sealed this
Nineteenth Day of August, 2014

Michelle K. Lee

Michelle K. Lee
*Deputy Director of the United States Patent and Trademark Office*